US012584301B2

(12) United States Patent
Hodge et al.

(10) Patent No.: US 12,584,301 B2
(45) Date of Patent: Mar. 24, 2026

(54) LAVATORY CARRIER ASSEMBLY WITH WASTE LINE ACCESS PORT

(71) Applicant: Watts Regulator Co., North Andover, MA (US)

(72) Inventors: Gary Hodge, Rutherfordton, NC (US); Robert Diplacido, Erie, PA (US); Trent Killian, Bostic, NC (US); Tyler Van Devon Herfel, Forest City, NC (US)

(73) Assignee: Watts Regulator Co., North Andover, MA (US)

( * ) Notice: Subject to any disclaimer, the term of this patent is extended or adjusted under 35 U.S.C. 154(b) by 344 days.

(21) Appl. No.: 18/386,570

(22) Filed: Nov. 2, 2023

(65) Prior Publication Data

US 2025/0146259 A1 May 8, 2025

(51) Int. Cl.
*E03C 1/328* (2006.01)

(52) U.S. Cl.
CPC ..... *E03C 1/328* (2013.01)

(58) Field of Classification Search
CPC . E03C 1/328; E03C 1/23; E03C 1/326; E03D 11/135
USPC ..... 4/252.1, 645, 643, 646, 252.2
See application file for complete search history.

(56) References Cited

U.S. PATENT DOCUMENTS 3,398,409 A 8/1968 Pope
5,724,773 A 3/1998 Hall
6,301,838 B1 10/2001 Hall
7,096,520 B2 8/2006 Nicolia et al.
7,458,389 B2 12/2008 Doverspike
9,328,493 B2 * 5/2016 Wroblewski ..... E03C 1/322
11,753,810 B2 * 9/2023 Barker ..... E03C 1/328 4/252.2
2024/0263431 A1 8/2024 Porter

OTHER PUBLICATIONS

Carrier Systems, Lavatory Carriers, Zurn Industries, LLC Brochure. Erie, PA., p. 15, Dec. 30, 2022, downloaded from website https://www.zurn.com/media-library/web_documents/pdfs/specsheets/z1231ez-wl on Aug. 28, 2024.
Watts Drainage, Waste Line Access, Jun. 3, 2022. Spindale, NC, 4 pages.
Office Action from related Chinese Appln. No. 202130801978.9, dated Jun. 21, 2023. English translation attached.
Watts Engineering Specification, Back-to-Back Floor Mounted Lavatory Carrier with Concealed Arms and Waste Line Access, 2023. 1 page.
Universal Concealed Arm Carrier System for Wall Hung Lavatory w/Waste line Sleeve, Zurn Z1231EZ-WL Specification Sheet, Mar. 24, 2020, 1 page.

* cited by examiner

*Primary Examiner* — Lauren A Crane
(74) *Attorney, Agent, or Firm* — Grossman, Tucker, Perreault & Pfleger, PLLC

(57) ABSTRACT

The present disclosure is generally directed to a lavatory carrier assembly. The assembly includes a first leg including an upper member, a lower member, and a waste line access port member; a second leg; and a horizontal spacing member coupled to the first leg and the second leg. The waste line access port member defines an opening to receive a waste pipe. The waste line access port member also defines an upper and lower slots to slidably receive the upper and lower members of the first leg in a generally horizontal manner.

21 Claims, 4 Drawing Sheets

LAVATORY CARRIER ASSEMBLY WITH WASTE LINE ACCESS PORT

TECHNICAL FIELD

The present disclosure is generally directed to plumbing equipment, and, more particularly, to an in-wall, lavatory carrier assembly with a waste line access port.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Although the following Detailed Description will proceed with reference being made to illustrative embodiments, many alternatives, modifications and variations thereof will be apparent to those skilled in the art.

DETAILED DESCRIPTION

Figure 1:
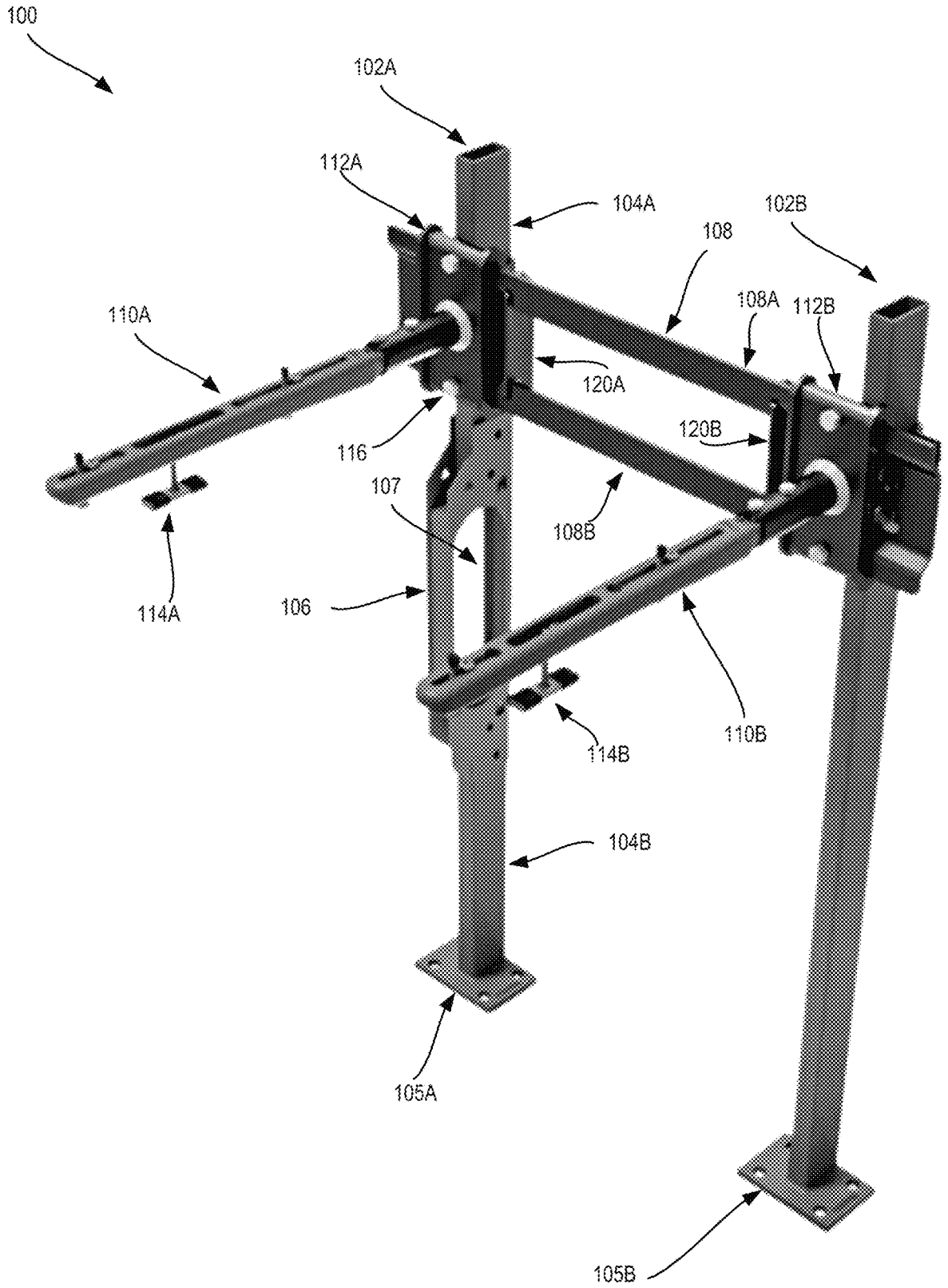
FIG. 1 is a perspective view of a lavatory carrier assembly according to one embodiment of the present disclosure.

FIG. 1 is a perspective view of a lavatory carrier assembly 100 according to one embodiment of the present disclosure. The carrier assembly 100 includes a first leg 102A and a second leg 102B coupled together via horizontal spacing member, shown generally at 108. The first leg 102A, second leg 102B and horizontal spacing member 108 are generally dimensioned to fit between two wall studs (not shown) within a wall (not shown), for example, between sheetrock, masonry, etc., where and overall width of the first leg 102A, second leg 102B and horizontal spacing member 108 is selected to fit within the spacing of a wall of standard 2×4 construction, 2×6 construction, etc. Legs 102A and 102B may each include flared feet portions 105A and 105B, respectively. The flared feet portions 105A and 105B may provide stability for the assembly 200, and may include holes or opening (as illustrated) to secure the feet portions 105A and 105B to, for example, a wall bottom plate, concrete, flooring, etc., using bolts, pins, etc.

The first leg 102A includes an upper member 104A, a lower member 104B and a waste line access member 106 disposed between the upper member 104A and lower member 104B. The waste line access member 106 defines a waste line access port 107 through which a plumbing waste line (not shown) can be routed through. Advantageously, and as will be described below, the waste line access member 106 is configured to slidably couple to the upper member 104A and lower member 104B in a generally horizontal manner, so that vertical assembly of the leg 102A is avoided.

The carrier assembly 100 also includes brackets 120A and 120B to couple the horizontal spacing member 108 to the first leg 102A and the second leg 102B, respectively. In particular, bracket 120A includes an opening (not shown) to receive the upper member 104A of leg 102A, and bracket 120B includes an opening (not shown) to receive leg 102B. The horizontal spacing member 108 is coupled to brackets 120A and 120B, as illustrated. In some embodiments, brackets 120A and/or 120B may be slidably coupled to horizontal spacing member 108 to enable legs 102A and/or 102B to slide along the length of the horizontal member 108, so that spacing between the legs 102A and 102B may be adjusted. The horizontal spacing member 108 includes upper and lower rails 108A and 108B, respectively, that span a portion of the length of the horizontal spacing member 108. Fixture brackets 112A and 112B are slidably coupled to the upper and lower rails 108A and 108B. Fixture brackets 112A and 112B may each have a C-shaped cross section to hold each bracket to the upper and lower rails 108A and 108B, as illustrated.

Fixture arms 110A and 110B may be coupled fixture brackets 112A and 112B, respectively. The fixture arms 110A and 110B may extend from the fixture brackets 112A and 112B such that the fixture arms 110A and 110B protrude through a wall (not shown). The fixture arms 110A and 110B are generally dimensioned to support a plumbing fixture (not shown), for example, a lavatory sink, etc., and may also include fastening screws 114A and 114B, respectively, to fasten to a plumbing fixture. The fixture brackets 112A and/or 112B may slide along rails 108A and 108B to adjust a spacing between the fixture arms 110A and 110B. Thus, the fixture arms 110A and 110B may be spaced apart independently of the spacing between the legs 102A and 102B. The fixture brackets 112A and/or 112B may be secured to the horizontal spacing member 108 using, for example, bolts (e.g., bolt 116), cotter pins, screws, etc.

Figure 2:
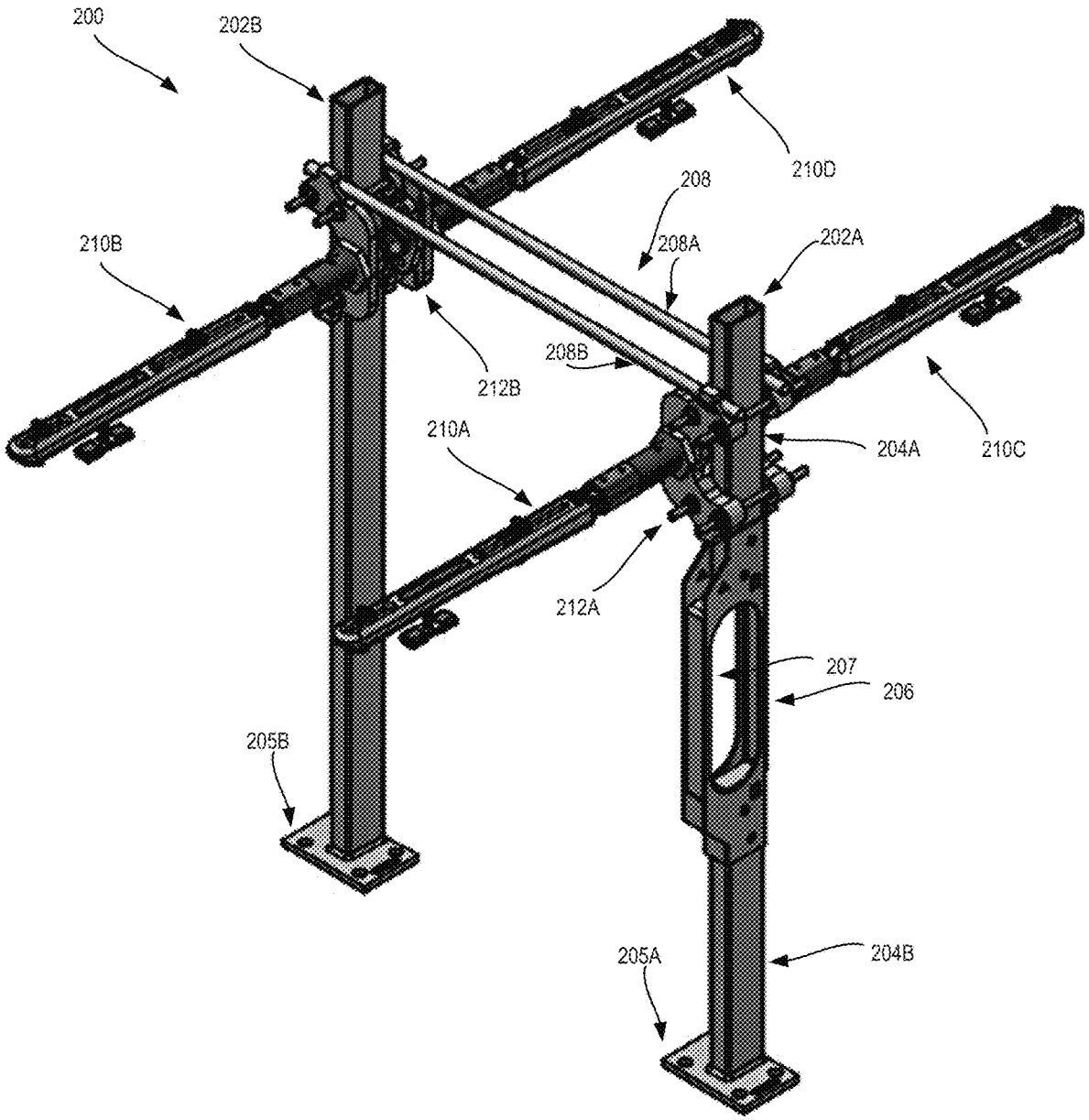
FIG. 2 is a perspective view of a lavatory carrier assembly according to another embodiment of the present disclosure.

FIG. 2 is a perspective view of a lavatory carrier assembly 200 according to another embodiment of the present disclosure. The carrier assembly 200 is a "dual-sided" carrier assembly to support lavatory sinks on both sides of a wall (not shown). The carrier assembly 200 includes a first leg 202A and a second leg 202B coupled together via horizontal spacing member, shown generally at 208. The first leg 202A, second leg 202B and horizontal spacing member 208 are generally dimensioned to fit between two wall studs (not shown) within a wall (not shown), for example, between sheetrock, masonry, etc., where and overall width of the first leg 202A, second leg 202B and horizontal spacing member 208 is selected to fit within the spacing of a wall of standard 2×4 construction, 2×6 construction, etc. Legs 202A and 202B may each include flared feet portions 205A and 205B, respectively. The flared feet portions 205A and 205B may provide stability for the assembly 200, and may include holes or opening (as illustrated) to secure the feet portions 205A and 205B to, for example, a wall bottom plate, concrete, flooring, etc., using bolts, pins, etc.

The carrier assembly 200 is similar to the carrier assembly 100 of FIG. 1, and includes a first set of fixture arms 210A and 210B disposed on one side of the assembly 200 and a second set of fixture arms 210C and 210D disposed on an opposing side of the assembly 200. In this embodiment, fixture brackets 212A and 210B are affixed to respective legs 202A and 202B. Fixture bracket 212A is affixed to the upper member 204A of leg 202A (using, for example, bolts, screws, pins, etc.). Arms 210A and 210C are affixed to bracket 212A in an opposing manner, as illustrated. Similarly, fixture bracket 212B is affixed to the upper portion of leg 202B (using, for example, bolts, screws, pins, etc.). Arms 210B and 210B are affixed to bracket 212B in an opposing manner, as illustrated. Fixture brackets 212A and 212B may be affixed along the length of respective legs 202A and 2102B to achieve a desired height of the arms 210A, 210B, 210C and 210D relative to the floor.

The first leg 202A includes an upper member 204A, a lower member 204B and a waste line access member 206 disposed between the upper member 204A and lower member 204B. The waste line access member 206 defines a waste line access port 207 through which a plumbing waste line (not shown) can be routed through. Advantageously, and as will be described below, the waste line access member 206 is configured to slidably couple to the upper member 204A and lower member 204B in a generally horizontal manner, so that vertical assembly of the leg 202A is avoided.

The horizontal spacing member 208 may include a first spacing member 108A and a second spacing member 108B coupled to bracket 212A and 212B, as illustrated. In this embodiment, spacing members 108A and 108B are generally elongated rod structures that are slidably coupled to brackets 212A and 212B, via opening defined in brackets 212A and 212B, as illustrated, so that spacing between the legs 202A and 202B may be adjusted.

Figures 3A, 3B:
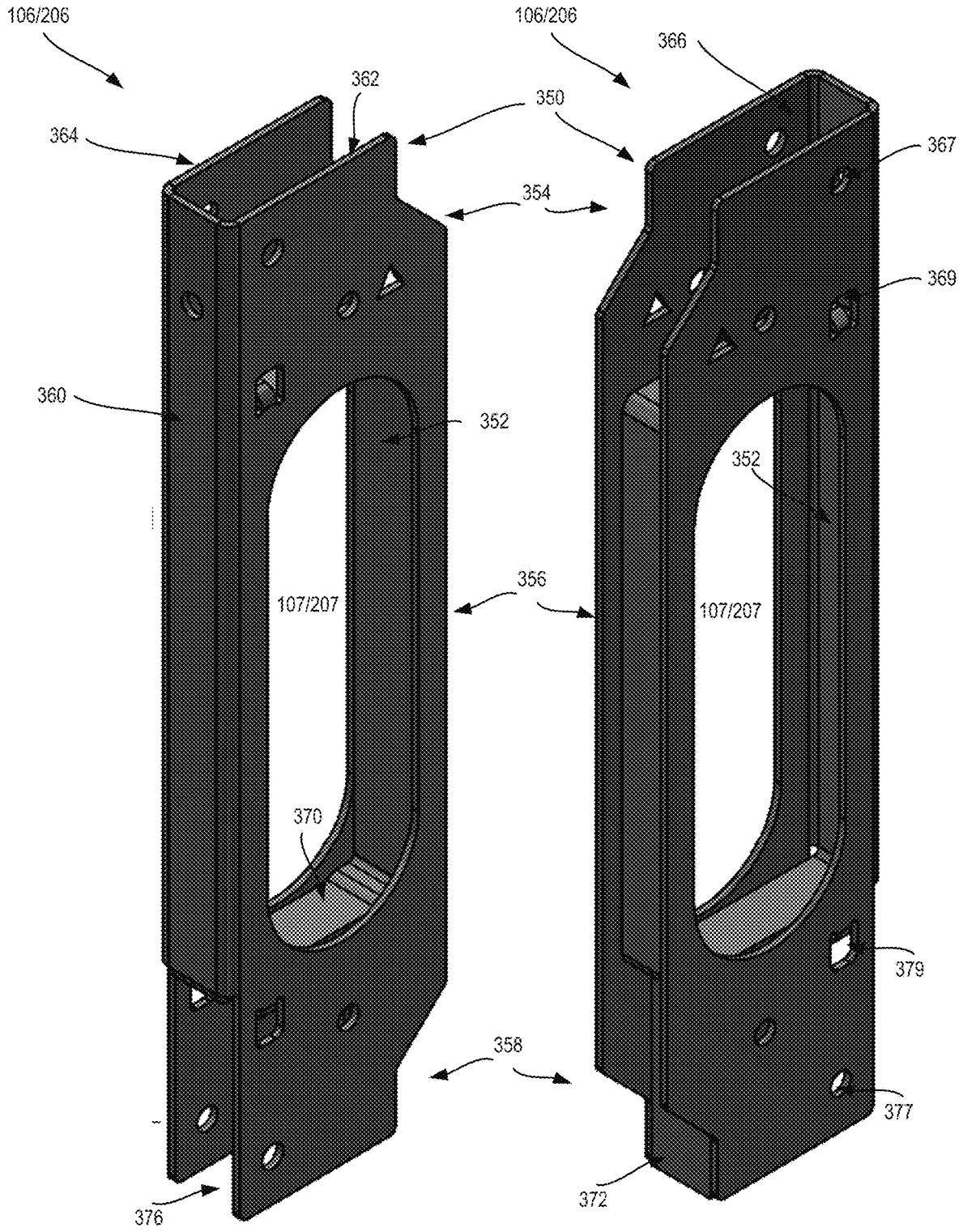
FIGS. 3A and 3B illustrate opposing perspective views of the waste line access member of FIGS. 1 and 2.

FIGS. 3A and 3B illustrate opposing perspective views of the waste line access member 106/206 described above with reference to FIGS. 1 and 2. As stated above, the waste line access member 106/206 generally provides horizontal attachment to the upper member 104A/204A and the lower member 104B/204B of leg 102A/202A, rather than requiring the leg 102A/202A to be assembled in a vertical fashion. Access member 106/206 has a generally trapezoidal or rectangular cross-sectional shape, and generally includes an outer jacket member 350 at least partially surrounding an inner sleeve member 352. The access member 106/206 includes an upper portion 354, a central portion 356 and a lower portion 358. The outer jacket member 350 includes a first side member 360 that spans a length from a top of the upper portion 354 to a bottom 370 of the central portion 356. The outer jacket member 350 also includes a front member 362 and back member 364 disposed approximately parallel to one another and normal to the first side member 360. The front member 362 and back member 364 have a length that defines an overall length of the access member 106/206.

An upper slot 366 is defined between the front member 362, back member 364, first side member 360 and a top portion 368 of the inner sleeve 352. The upper slot 366 is open on the top and the side opposite first side member 360, and is dimensioned to receive the upper member 104A/204A of leg 102A/202A. Thus, the access member 106/206 is configured to slide into the upper member 104A/204A of leg 102A/202A from the side, i.e., generally horizontal sliding the upper member 104A/204A into slot 366. The front member 362 and back member 364 may include one or more coincident openings (one of which is shown at opening 367) and the upper member 104A/204A may include corresponding openings (not shown) dimensioned to receive a bolt, pin, etc. to affix the access member 106/206 to the upper member 104A/204A of leg 102A/202A. In addition, the front member 362 and back member 364 may include one or more tabs 369 having a portion thereof bent inward into the slot 366. Tab 369 may operate to limit movement of the upper member 104A/204A into the upper slot 366.

The lower portion 358 of the access member 106/206 includes a second side member 372 disposed generally opposite of the first side member 360 and offset from the first side member 360. A lower slot 376 is defined between the front member 362, back member 364, second side member 372 and a bottom portion 370 of the inner sleeve 352. The lower slot 376 is open on the bottom and the side opposite second side member 372, and is dimensioned to receive the lower member 104B/204B of leg 102A/202A. Thus, the access member 106/206 is configured to slide into the lower member 104B/204B of leg 102A/202A from the side, i.e., generally horizontal sliding the lower member 104B/204B into slot 376. The front member 362 and back member 364 may include one or more coincident openings (one of which is shown at opening 377) and the lower member 104B/204B may include corresponding openings (not shown) dimensioned to receive a bolt, pin, etc. to affix the access member 106/206 to the lower member 104B/204B of leg 102A/202A. In addition, the front member 362 and back member 364 may include one or more tabs 379 having a portion thereof bent inward into the slot 376. Tab 369 may operate to limit movement of the lower member 104B/204B into the lower slot 376.

Figure 4:
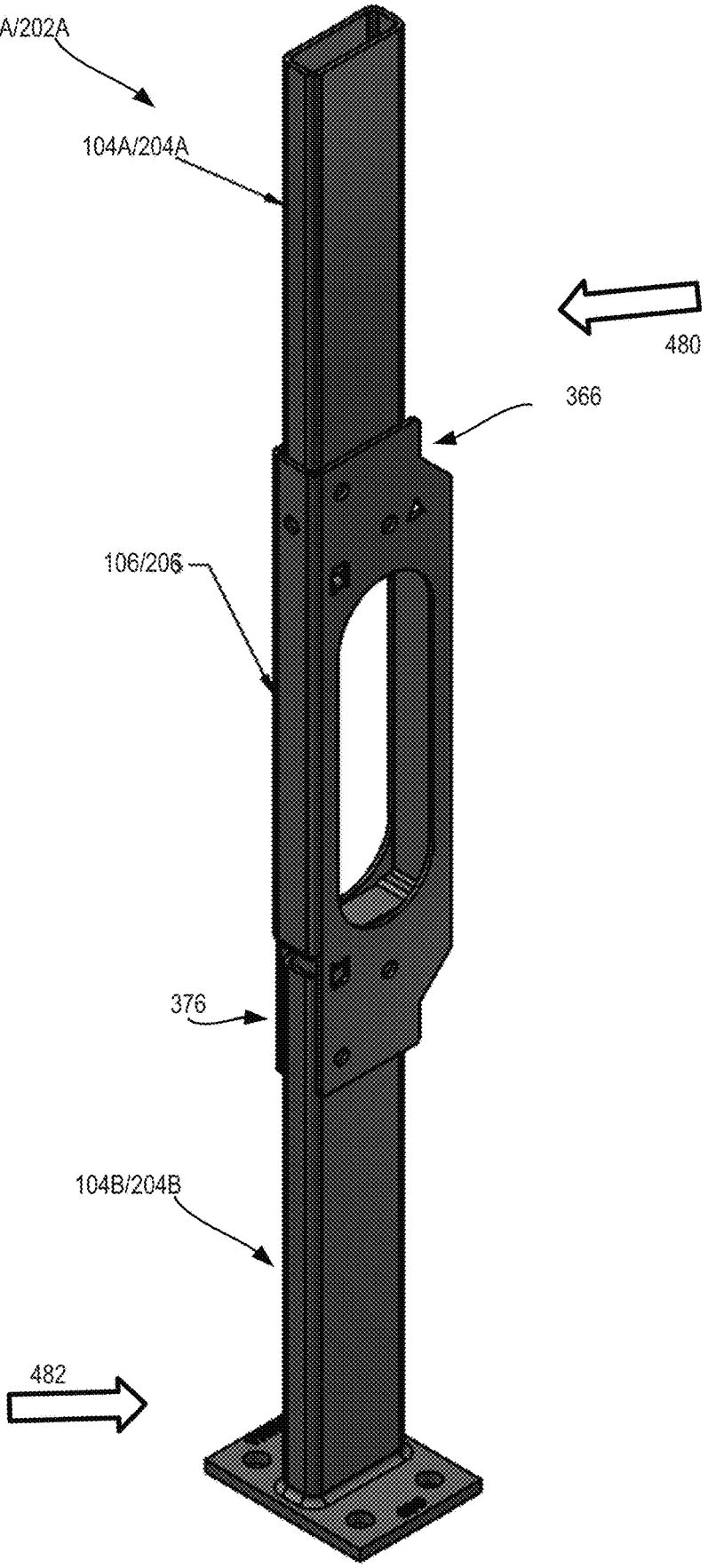
FIG. 4 illustrates a perspective view of the assembled leg of FIGS. 1 and 2.

FIG. 4 illustrates a perspective view of the assembled leg 102A/202A of FIGS. 1 and 2. As illustrated, to assemble the leg 102A/202A, the upper member 104A/204A is dimensioned to slide into slot 366 of the access member 106/206, as indicated by arrow 480. Similarly, the lower member 104B/204B is dimensioned to slide into slot 376 of the access member 106/206, as indicated by arrow 482. These features enable assembly of the leg 102A/202A to be done in a horizontal manner, as opposed to vertical couple of the leg segments. This may offer significant advantages, particularly in "tight" work environments where vertical assembly of the leg segments would be difficult or impossible to achieve.

Accordingly, in one embodiment the present disclosure provides a lavatory carrier assembly that includes a first leg including an upper member, a lower member, and a waste line access port member; a second leg; and a horizontal spacing member coupled to the first leg and the second leg. The waste line access port member including an outer jacket at least partially surrounding an inner sleeve member, the inner sleeve member defining an opening to receive a waste pipe; and wherein the outer jacket defining an upper slot having a side opening on a first side of the waste line access port, the upper slot to slidably receive the upper member in a generally horizontal manner; and wherein the outer jacket also defining a lower slot having an opening on a second side of the waste line access port, the lower slot to slidably receive the lower member in a generally horizontal manner.

In another embodiment, the present disclosure provides a lavatory carrier assembly that includes a first leg including an upper member, a lower member, and a waste line access port member; wherein the waste line access port member including an outer jacket at least partially surrounding an inner sleeve member, the inner sleeve member defining an opening to receive a waste pipe; and wherein the outer jacket defining an upper slot having a side opening on a first side of the waste line access port, the upper slot to slidably receive the upper member in a generally horizontal manner; and wherein the outer jacket also defining a lower slot having an opening on a second side of the waste line access port, the lower slot to slidably receive the lower member in a generally horizontal manner. The lavatory carrier assembly also includes a second leg; a horizontal spacing member coupled to the first leg and the second leg, the horizontal spacing member including upper and lower rail members; first and second fixture brackets slidably coupled to the upper and lower rail members; and first and second fixture arms coupled to and extending from the first and second fixture brackets, respectively, the fixture arms extending generally normal to the first leg and second leg, respectively.

In yet another embodiment, the present disclosure provides a lavatory carrier assembly that includes a first leg including an upper member, a lower member, and a waste line access port member; wherein the waste line access port member including an outer jacket at least partially surrounding an inner sleeve member, the inner sleeve member defining an opening to receive a waste pipe; and wherein the outer jacket defining an upper slot having a side opening on a first side of the waste line access port, the upper slot to slidably receive the upper member in a generally horizontal manner; and wherein the outer jacket also defining a lower slot having an opening on a second side of the waste line access port, the lower slot to slidably receive the lower member in a generally horizontal manner; a second leg; a horizontal spacing member coupled to the first leg and the second leg; first and second fixture brackets slidably coupled to first and second legs, respectively; and wherein the horizontal spacing member comprises first and second rail members slidably coupled to the first and second fixture brackets, respectively; first and second fixture arms coupled to and extending from the first and second fixture brackets, respectively, the fixture arms extending generally normal to the first leg and second leg, respectively; a third fixture arm coupled to the first fixture bracket and disposed opposite to the first fixture arm; and a fourth fixture arm coupled to the second fixture bracket and disposed opposite to the second fixture arm.

As used herein, the terms "side", "front", "back", etc. are provided as a descriptive aid, not as a limitation or specific orientation. While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A lavatory carrier assembly, comprising:

a first leg including an upper member, a lower member, and a waste line access port member;

a second leg; and a horizontal spacing member coupled to the first leg and the second leg;

wherein the waste line access port member including an outer jacket at least partially surrounding an inner sleeve member, the inner sleeve member defining an opening to receive a waste pipe; and wherein the outer jacket defining an upper slot having a side opening on a first side of the waste line access port, the upper slot to slidably receive the upper member in a generally horizontal manner; and wherein the outer jacket also defining a lower slot having an opening on a second side of the waste line access port, the lower slot to slidably receive the lower member in a generally horizontal manner.

2. The lavatory carrier assembly of claim 1, wherein the horizontal spacing member comprises upper and lower rail member; and wherein the lavatory carrier assembly further comprises first and second fixture brackets slidably coupled to the upper and lower rail members.

3. The lavatory carrier assembly of claim 2, further comprising first and second fixture arms coupled to and extending from the first and second fixture brackets, respectively, the fixture arms extending generally normal to the first leg and second leg, respectively.

4. The lavatory carrier assembly of claim 1, further comprising first and second fixture brackets slidably coupled to first and second legs, respectively; and wherein the horizontal spacing member comprises first and second rail members slidably coupled to the first and second fixture brackets, respectively.

5. The lavatory carrier assembly of claim 4, further comprising first and second fixture arms coupled to and extending from the first and second fixture brackets, respectively, the fixture arms extending generally normal to the first leg and second leg, respectively; and further comprising a third fixture arm coupled to the first fixture bracket and disposed opposite to the first fixture arm, and a fourth fixture arm coupled to the second fixture bracket and disposed opposite to the second fixture arm.

6. The lavatory carrier assembly of claim 1, wherein the upper slot is bound on three sides by the outer jacket and bound by the inner sleeve member.

7. The lavatory carrier assembly of claim 1, wherein the lower slot is bound on three sides by the outer jacket and bound by the inner sleeve member.

8. The lavatory carrier assembly of claim 1, wherein the outer jacket includes a tab portion with a tab member extending into the upper slot, the tab member being to define an insertion distance of the upper member into the upper slot.

9. The lavatory carrier assembly of claim 1, wherein the outer jacket includes a tab portion with a tab member extending into the lower slot, the tab member being to define an insertion distance of the lower member into the lower slot.

10. The lavatory carrier assembly of claim 1, wherein the first leg and second leg each include flared feet portions.

11. The lavatory carrier assembly of claim 1, wherein the first and second leg are slidably coupled to the horizontal spacing member to adjust a spacing between the first and second legs.

12. A lavatory carrier assembly, comprising:

a first leg including an upper member, a lower member, and a waste line access port member; wherein the waste line access port member including an outer jacket at least partially surrounding an inner sleeve member, the inner sleeve member defining an opening to receive a waste pipe; and wherein the outer jacket defining an upper slot having a side opening on a first side of the waste line access port, the upper slot to slidably receive the upper member in a generally horizontal manner; and wherein the outer jacket also defining a lower slot having an opening on a second side of the waste line access port, the lower slot to slidably receive the lower member in a generally horizontal manner;

a second leg;

a horizontal spacing member coupled to the first leg and the second leg, the horizontal spacing member including upper and lower rail members;

first and second fixture brackets slidably coupled to the upper and lower rail members; and first and second fixture arms coupled to and extending from the first and second fixture brackets, respectively, the fixture arms extending generally normal to the first leg and second leg, respectively.

13. The lavatory carrier assembly of claim 12, wherein the upper slot is bound on three sides by the outer jacket and bound by the inner sleeve member.

14. The lavatory carrier assembly of claim 12, wherein the lower slot is bound on three sides by the outer jacket and bound by the inner sleeve member.

15. The lavatory carrier assembly of claim 12, wherein the outer jacket includes a tab portion with a tab member extending into the upper slot, the tab member being to define an insertion distance of the upper member into the upper slot; and wherein the outer jacket includes a tab portion with a tab member extending into the lower slot, the tab member being to define an insertion distance of the lower member into the lower slot.

16. The lavatory carrier assembly of claim 12, wherein the first and second leg are slidably coupled to the horizontal spacing member to adjust a spacing between the first and second legs.

17. A lavatory carrier assembly, comprising:

a first leg including an upper member, a lower member, and a waste line access port member; wherein the waste line access port member including an outer jacket at least partially surrounding an inner sleeve member, the inner sleeve member defining an opening to receive a waste pipe; and wherein the outer jacket defining an upper slot having a side opening on a first side of the waste line access port, the upper slot to slidably receive the upper member in a generally horizontal manner; and wherein the outer jacket also defining a lower slot having an opening on a second side of the waste line access port, the lower slot to slidably receive the lower member in a generally horizontal manner;

a second leg;

a horizontal spacing member coupled to the first leg and the second leg;

first and second fixture brackets slidably coupled to first and second legs, respectively; and wherein the horizontal spacing member comprises first and second rail members slidably coupled to the first and second fixture brackets, respectively;

first and second fixture arms coupled to and extending from the first and second fixture brackets, respectively, the fixture arms extending generally normal to the first leg and second leg, respectively;

a third fixture arm coupled to the first fixture bracket and disposed opposite to the first fixture arm; and a fourth fixture arm coupled to the second fixture bracket and disposed opposite to the second fixture arm.

18. The lavatory carrier assembly of claim 17, wherein the upper slot is bound on three sides by the outer jacket and bound by the inner sleeve member.

19. The lavatory carrier assembly of claim 17, wherein the lower slot is bound on three sides by the outer jacket and bound by the inner sleeve member.

20. The lavatory carrier assembly of claim 17, wherein the outer jacket includes a tab portion with a tab member extending into the upper slot, the tab member being to define an insertion distance of the upper member into the upper slot; and wherein the outer jacket includes a tab portion with a tab member extending into the lower slot, the tab member being to define an insertion distance of the lower member into the lower slot.

21. The lavatory carrier assembly of claim 17, wherein the first and second leg are slidably coupled to the horizontal spacing member to adjust a spacing between the first and second legs.

* * * * *